US006629734B2

(12) United States Patent
Maoz

(10) Patent No.: US 6,629,734 B2
(45) Date of Patent: Oct. 7, 2003

(54) FOLDABLE STOOL

(76) Inventor: Gil Maoz, P.O. Box 2129, Gan Yavne (IL)

( * ) Notice: Subject to any disclaimer, the term of this patent is extended or adjusted under 35 U.S.C. 154(b) by 0 days.

(21) Appl. No.: 09/836,476

(22) Filed: Apr. 18, 2001

(65) Prior Publication Data

US 2002/0043866 A1 Apr. 18, 2002

(30) Foreign Application Priority Data

May 14, 2000 (IL) ..... 136120

(51) Int. Cl.[7] ..... A47C 7/00

(52) U.S. Cl. ..... 297/440.12; 297/423.39; 297/16.2; 297/42

(58) Field of Search ..... 297/440.12, 423.39, 297/423.41, 42, 16.2; 248/174, 188.8, 909; 229/198.3, 103, 104; 108/115

(56) References Cited

U.S. PATENT DOCUMENTS 3,566,808 A * 3/1971 Slate et al. ..... 108/157.14
3,717,377 A * 2/1973 Johnson ..... 297/440.12
3,972,084 A * 8/1976 Reynolds ..... 470/9
4,037,281 A * 7/1977 Reynolds ..... 470/10
4,533,179 A * 8/1985 Nichols et al. ..... 108/115
5,382,081 A * 1/1995 Henry ..... 206/815
5,445,435 A * 8/1995 Sheckles ..... 297/440.12
6,206,473 B1 * 3/2001 Kondratiev ..... 297/440.1
2002/0063419 A1 * 5/2002 Susko

* cited by examiner

*Primary Examiner*—Peter M. Cuomo
*Assistant Examiner*—Erika Garrett
(74) *Attorney, Agent, or Firm*—Dekel Patent Ltd.; David Klein

(57) ABSTRACT

Apparatus including a generally flat sheet with a plurality of score lines formed thereon, the score lines defining a contour of a resting surface, a plurality of legs and a plurality of web portions all contiguous with each other. The sheet may be folded about the score lines to form a stool placeable upon a supporting surface, wherein the resting surface is distanced from the supporting surface and the legs extend from the resting surface to the supporting surface, and adjacent web portions are fastened to each other.

11 Claims, 3 Drawing Sheets

FOLDABLE STOOL

FIELD OF THE INVENTION

The present invention relates generally to a foldable or collapsible stool or similar support apparatus.

BACKGROUND OF THE INVENTION

Portable and collapsible stools are well known in the art. For example, U.S. Pat. No. 5,489,144 to Lewis describes a portable folding footstool for supporting the legs of an individual relative to a ground surface. The footstool has a support member receiving the individual's legs thereon, and a folding leg assembly for positioning the support member above the ground surface, which can be folded flatly against the support member for storage and transportation purposes. However, the Lewis footstool suffers form the disadvantage of a relatively large number of parts, thereby increasing manufacturing and construction costs and time. Even in the folded position, the Lewis footstool still takes up a relatively large volume.

U.S. No. Pat. 6,036,269 to Colton describes a foldable footstool constructed of plastic or paperboard, or corrugated plastic such as COROPLAST or paperboard. The footstool is foldably constructed from a flat blank of the material to form a closed-top footstool, which can be used for resting one's feet upon. The foldable laminated footstool includes a top portion and a foldably attached crossing bottom assembly wherein slots or the equivalent provided in crossing members of the bottom crossing allow for the foldably attached crossing bottom assembly to securedly assemble into a rigid-like assembled position. The crossing bottom assembly comprises four crossing members. Each crossing member has a slot of sufficient width so that, upon assembly, each crossing member can foldably cross under the top portion of the footstool, and become securedly fixed within the slots of other crossing members.

However, in the flat blank of the material, the crossing bottom assembly protrudes outwards of the top portion. Since the crossing members are slender and elongate, they are prone to unintentional bending, crimping and other damage when in the flat, unfolded position. Colton attempts to solve this problem by providing fastening means, such as VELCRO strips, for securing the crossing members in a flat configuration for carrying. The fastening means is said to prevent the unintentional unfolding of the crossing bottom assembly. However, the added thickness of the crossing members in the folded position adds to the overall thickness of the footstool in the folded position, thereby consuming more volume for storage and transportation.

SUMMARY OF THE INVENTION

The present invention seeks to provide an improved collapsible or foldable stool. In one preferred embodiment, a generally flat arcuate sheet is folded along score lines to form the stool. The sheet is preferably made of a thin, yet strong and resilient plastic. The finished stool is sturdy and strong, and can even support the weight of a heavy adult. When the sheet is flat, the stools may be stacked very compactly for ease of transportation and storage.

The term stool, as used throughout the disclosure, refers to any kind of support apparatus, such as relatively low structures used for resting feet thereupon, any kind of stool for sitting or resting thereupon, and any kind of support device for laying or resting objects and persons thereupon.

There is thus provided in accordance with a preferred embodiment of the present invention apparatus including a generally flat sheet with a plurality of score lines formed thereon, the score lines defining a contour of a resting surface, a plurality of legs and a plurality of web portions all contiguous with each other. Adjacent web portions are preferably fastenable to each other.

In accordance with a preferred embodiment of the present invention a plurality of fasteners are provided, each fastener adapted to fasten a pair of the web portions together. The fasteners may be integrally formed with the sheet. For example, the fasteners may be a slit and tongue cut out in adjacent web portions, wherein the tongue snugly fits into the slit. Another example is a snap fastener integrally molded with the sheet, such as by means of injection molding. In accordance with another preferred embodiment of the present invention, the sheet has holes formed therein for the fasteners to pass therethrough. The fasteners may include threaded fasteners, or snap fasteners attached to the sheet, for example.

In accordance with a preferred embodiment of the present invention the score lines are arcuate, and may be shaped generally like a contour of a conic section.

Further in accordance with a preferred embodiment of the present invention the score lines are generally symmetric about a center point of the sheet.

Still further in accordance with a preferred embodiment of the present invention the sheet is folded about the score lines to form a stool placeable upon a supporting surface, wherein the resting surface is distanced from the supporting surface and the legs extend from the resting surface to the supporting surface, and adjacent web portions are fastened to each other with the fasteners.

The sheet may be constructed of a material, which when folded about the score lines, bends generally in a bowed formation. For example, the sheet may be constructed of a flexible material, such as polypropylene.

There is also provided in accordance with a preferred embodiment of the present invention a method for forming a stool including providing a generally flat sheet with a plurality of score lines formed thereon, the score lines defining a contour of a resting surface, a plurality of legs and a plurality of web portions all contiguous with each other, folding the sheet about the score lines to form a stool placeable upon a supporting surface, wherein the resting surface is distanced from the supporting surface and the legs extend from the resting surface to the supporting surface, and fastening adjacent web portions to each other.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
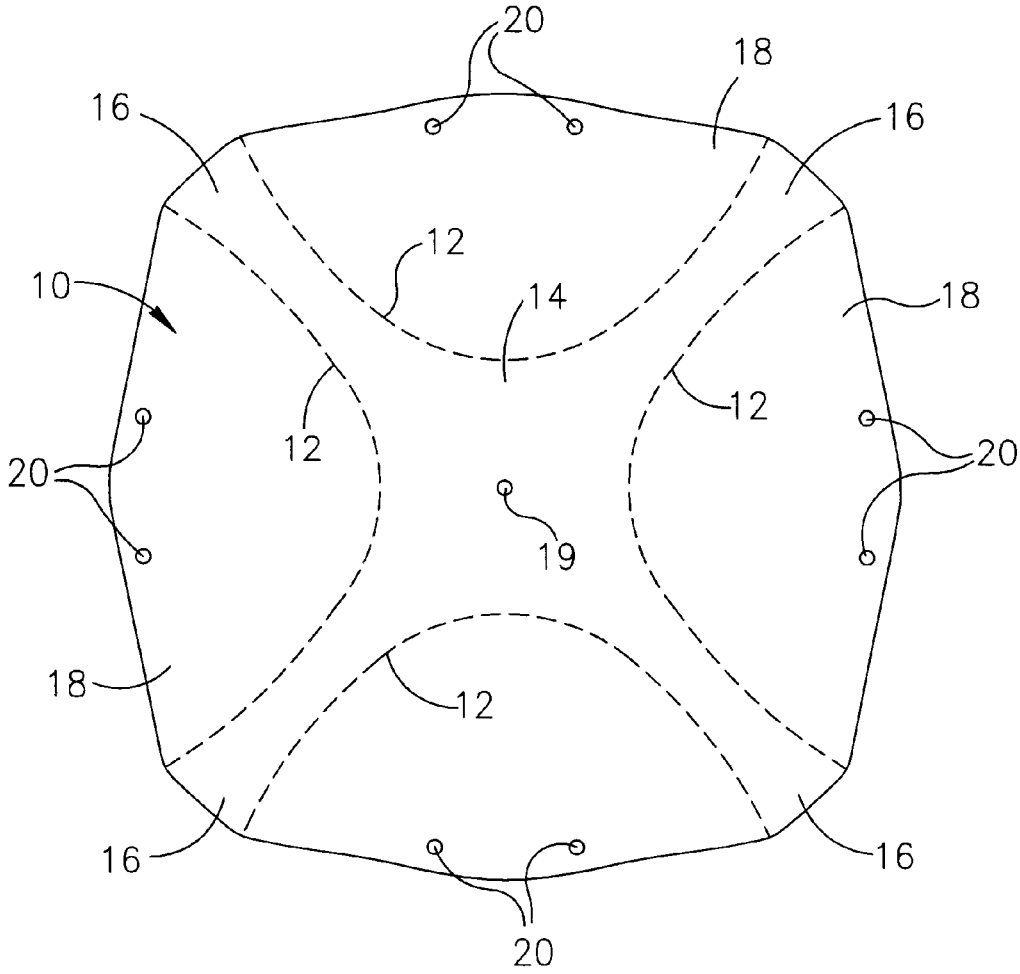
FIG. 1 is a simplified pictorial illustration of apparatus comprising a flat sheet foldable into a stool, in accordance with a preferred embodiment of the present invention.

Reference is now made to FIG. 1, which illustrates a generally flat sheet 10 preferably constructed of a flexible material, such as polypropylene. Such a material provides the requisite resilience for folding sheet 10, yet is very strong and durable, capable of supporting a person with a weight of well over 100 kg, for example. The material of sheet 10 is also preferably transparent or translucent and may have designs formed thereon. Sheet 10 may be made from other types of flexible material, such as thin sheet metal, cardboard or thin wood, for example.

Sheet 10 is formed with a plurality of score lines 12. Score lines 12 define a contour of a resting surface 14, a plurality of legs 16 and a plurality of web portions 18 all contiguous with each other. Score lines 12 are preferably arcuate, and may be shaped generally like a contour of a conic section, such as a hyperbolic or parabolic shape. Score lines 12 are preferably generally symmetric about a center point 19 of sheet 10.

Sheet 10 may have a generally circular shape. The outer contour of sheet 10 may not be a perfect circle, but rather comprise different arcuate sections of slightly different radii of curvature. The slightly different curved sections may facilitate folding and forming the sheet 10 into a stool.

A plurality of fasteners are provided for fastening pairs of adjoining web portions 18 together. For example, sheet 10 may have holes 20 formed therein for threaded fasteners to pass therethrough, such as a bolt 22 and nut 24, shown in FIGS. 2C and 3. Alternatively, the fasteners may comprise snap fasteners 26 (one of which is shown in FIG. 2C). The fasteners may be integrally formed with sheet 10. For example, plastic snap-type fasteners may be injection molded together with sheet 10. As a further alternative, combinations of different kinds and colors of fasteners may be employed.

Figure 2A:
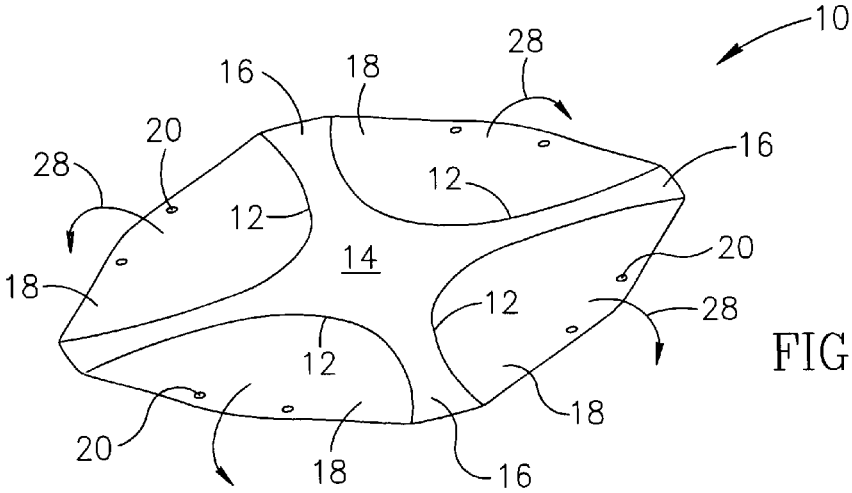
FIGS. 2A and 2B are simplified pictorial illustrations of the sheet of FIG. 1 in first and second stages of being folded into a stool.
Figure 2B:
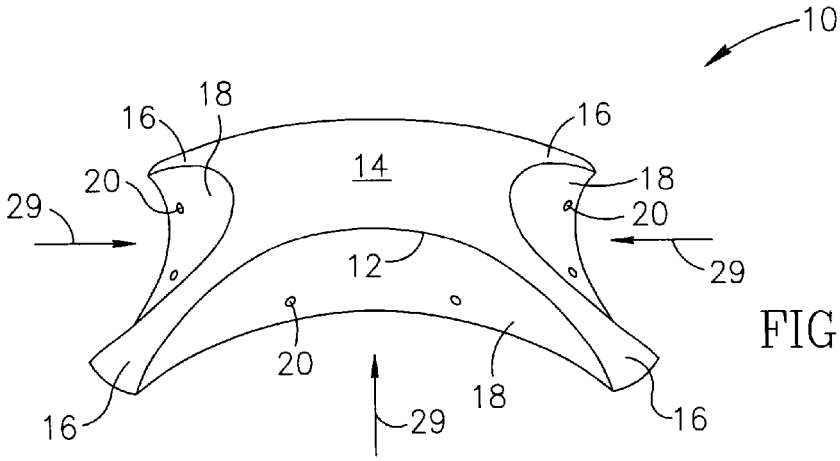
Figure 2C:
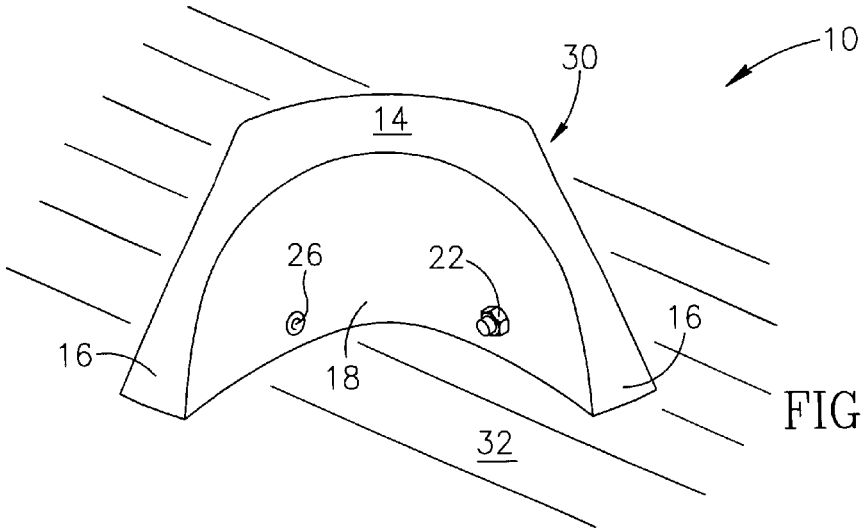
FIGS. 2C and 3 are simplified top-view and bottom-view pictorial illustrations, respectively, of the sheet of FIG. 1 folded into a finished stool.
Figure 3:
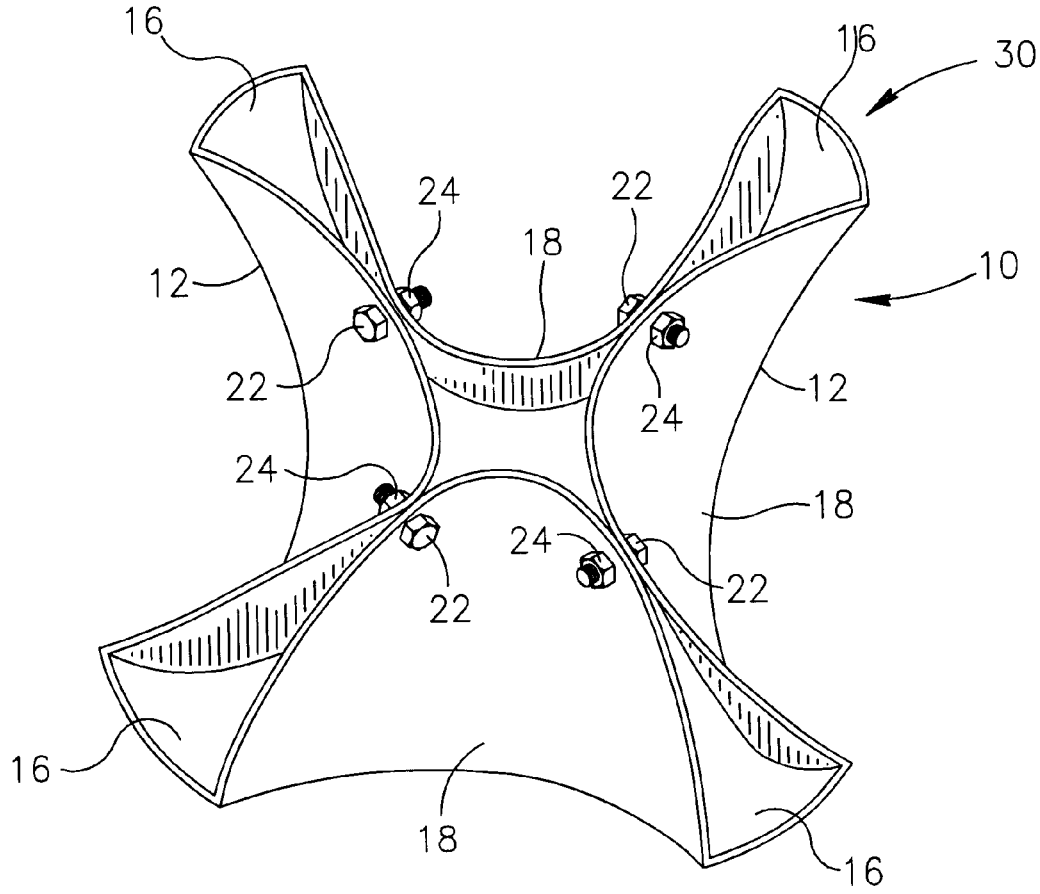

As seen in FIG. 2, web portions 18 of sheet 10 may be folded inwards about score lines 12, generally in the direction of arrows 28. This folding action moves resting surface 14 upwards and brings adjacent web portions 18 towards each other. The web portions 18 are brought against each other and fastened by means of the fasteners, as seen in FIGS. 3 and 4, thereby forming a stool 30, which may be placed upon a supporting surface 32, such as a floor (FIG. 3). In the finished stool, resting surface 14 is distanced from supporting surface 32 and legs 16 extend from resting surface 14 to supporting surface 32. Virtually the entire contour of sheet 10 may rest upon supporting surface 32 in the finished stool 30.

It is noted that the material of sheet 10, when folded about score lines 12, bends generally in a bowed formation, as seen in FIGS. 2C and 3. The bowed formation imparts stiffness and strength to the finished stool 30.

It will be appreciated by person skilled in the art, that the present invention is not limited by what has been particularly shown and described herein above. Rather the scope of the present invention is defined only by the claims that follow:

What is claimed is:

1. Apparatus comprising:

a generally flat, single sheet with a plurality of score lines formed thereon, said score lines defining a contour of a resting surface, and a plurality of legs and a plurality of web portions all contiguous with each other, said resting surface comprising a planar, non-edge portion of said sheet; and a plurality of fasteners, each fastener adapted to fasten a pair of said web portions together, wherein said single sheet is folded about said score lines to form a stool placeable upon a supporting surface, wherein said resting surface is generally horizontal and distanced from said supporting surface, and said legs are generally vertical and extend from said resting surface to said supporting surface, and adjacent web portions are fastened to each other with said fasteners.

2. Apparatus according to claim 1 wherein said fasteners are integrally formed with said sheet.

3. Apparatus according to claim 1, wherein at least one of said score lines is arcuate.

4. Apparatus according to claim 1, wherein said score lines have a conic section-shaped contour.

5. Apparatus according to claim 1, wherein said score lines are generally symmetric about a center point of said sheet.

6. Apparatus according to claim 1, wherein said sheet is constructed of a flexible material.

7. Apparatus according to claim 1, wherein said sheet is constructed of a material, which when folded about said score lines, bends generally in a bowed formation.

8. Apparatus according to claim 6 wherein said flexible material comprises polypropylene.

9. Apparatus according to claim 1, wherein said sheet has holes formed therein for said fasteners to pass therethrough.

10. Apparatus according to claim 1, wherein said fasteners comprise threaded fasteners.

11. Apparatus according to claim 1, wherein said fasteners comprise snap fasteners attached to said sheet.

* * * * *